US007246959B2

(12) United States Patent
Nakatani

(10) Patent No.: US 7,246,959 B2
(45) Date of Patent: Jul. 24, 2007

(54) IMAGE FORMATION APPARATUS AND SUBLIMATION PRINTER

(75) Inventor: Masaki Nakatani, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/111,731

(22) Filed: Apr. 22, 2005

(65) Prior Publication Data

US 2005/0243159 A1 Nov. 3, 2005

(30) Foreign Application Priority Data

Apr. 28, 2004 (JP) ..... 2004-132722

(51) Int. Cl.
*B41J 2/315* (2006.01)

(52) U.S. Cl. ..... 400/120.16; 347/197

(58) Field of Classification Search ..... 347/197, 347/198, 220, 221, 222
See application file for complete search history.

(56) References Cited

U.S. PATENT DOCUMENTS

| | | | | |
|---|---|---|---|---|
| 5,625,400 | A * | 4/1997 | Kubo | 347/197 |
| 5,697,714 | A * | 12/1997 | Onuki et al. | 400/120.16 |
| 5,746,520 | A * | 5/1998 | Kohira | 400/120.01 |
| 5,825,392 | A * | 10/1998 | Mochizuki | 347/197 |
| 5,940,108 | A * | 8/1999 | Ito | 347/197 |
| 6,046,757 | A * | 4/2000 | Kanai | 347/197 |
| 6,398,434 | B1 * | 6/2002 | Corrigan, Jr. | 400/120.17 |
| 6,538,680 | B2 * | 3/2003 | Sato | 347/197 |
| 2004/0080603 | A1 * | 4/2004 | Ito et al. | |
| 2005/0212894 | A1 * | 9/2005 | Sasaki et al. | |
| 2006/0082636 | A1 * | 4/2006 | Maruyama | |

FOREIGN PATENT DOCUMENTS

| | | | |
|---|---|---|---|
| JP | 58-55276 | | 4/1983 |
| JP | 04-027560 | * | 1/1992 |
| JP | 04-140176 | * | 5/1992 |
| JP | 05-050704 | * | 3/1993 |
| JP | 05-286201 | * | 11/1993 |
| JP | 05-318876 | * | 12/1993 |
| JP | 07-12246 U | | 2/1995 |
| JP | 3064307 | | 9/1999 |

* cited by examiner

*Primary Examiner*—Daniel J. Colilla
*Assistant Examiner*—N. Ha
(74) *Attorney, Agent, or Firm*—Global IP Counselors, LLP

(57) ABSTRACT

An image formation apparatus or a sublimation printer includes a main frame, a platen roller, a head assembly, and a press lever. The platen roller is rotatably held between first and second side panels of the main frame. The press lever is pivotably supported on the first side panel of the main frame. The press lever presses the head portion against the platen roller with a predetermined pressing force when the press lever is pivoted. The first side panel has a groove that supports the press lever. The groove has a first wall portion on which the press lever abuts from a direction of the reaction force of the pressing force. The sublimation printer does not get deformed after repeated use, and therefore can generate the predetermined pressing force in a stable manner.

12 Claims, 4 Drawing Sheets

PRIOR ART

IMAGE FORMATION APPARATUS AND SUBLIMATION PRINTER

BACKGROUND OF THE INVENTION

Field of the Invention

The present invention relates to an image formation apparatus and a sublimation printer. More specifically, the present invention relates to an image formation apparatus and a sublimation printer which transfer ink from an ink ribbon onto paper by electrical heating of a thermal head.

In a sublimation printer, a head assembly having a thermal head is disposed across from a platen roller. The printing of text or graphics is accomplished by laying an ink ribbon and paper one over the other, passing them between the thermal head and the platen roller, and applying heat to the thermal head during this passage so that the ink in the ink ribbon will be transferred to the paper. With such sublimation printer, the ink ribbon must be pressed against the paper with enough pressure to print text or graphics distinctly on the paper, and various mechanisms have been devised in the past for generating this necessary pressing force. Japanese Patent Application Publication S58-55276 and Japanese Utility Model Application Publication H7-12246 disclose examples of such attempts.

In some conventional sublimation printers, the pressing force is generated by using a structure such as one shown in FIG. 5.

FIG. 5 is a diagram of the structure of the press lever of a conventional dye sublimation printer. As shown in FIG. 5, this sublimation printer includes side panels 1', a lid 2' disposed at the top of the side panels 1', and a bottom panel (not shown). A groove 11' that extends vertically is formed at a predetermined location of the side panel 1', and a protrusion 21' that is partially fitted into the groove 11' is formed in the lid 2'.

This sublimation printer is also provided with a press lever 4' that pivots to press down on a boss 30' of a head assembly 3'. The press lever 4' includes a rotary shaft 42' that is fitted into the bottom of the groove 11' and is rotatably supported by the bottom and side walls of the groove 11' and the top of the protrusion 21' of the lid 2'; a fan plate 41' that is coupled to the rotary shaft 42' and whose main plane is perpendicular to the rotary shaft 42'; a torsion spring 43' that is disposed on the fan plate 41' and comes into contact with the boss 30' when the fan plate 41' is pivoted; and a torsion spring fixing member 44' that fixedly holds the torsion spring 43' to the fan plate 41'. With this structure, when the fan plate 41' of the press lever 4' pivots, the torsion spring 43' presses down on the boss 30', which pushes the head assembly 3' down. As a result, the head assembly 3' is pressed against the platen roller through the paper and the ink ribbon.

With this conventional sublimation printer constitution, however, the press lever 4' is subjected to a reaction force F when the head assembly 3' presses against the platen roller. Here, since the rotary shaft 42' of the press lever 4' is held from above by the protrusion 21' of the lid 2', the above-mentioned reaction force F causes the force from the rotary shaft 42' of the press lever 4' to act on the protrusion 21' of the lid 2'. Since the lid 2' is formed from a thin sheet of metal or the like, the lid 2' often ends up being deformed over the course of repeated printing, in other words, over the repeated pressing of the platen roller by the head assembly 3'. This is a problem in that, once the lid 2' is deformed, the sublimation printer will no longer be able to produce the required pressing force.

In view of the above, it will be apparent to those skilled in the art from this disclosure that there exists a need for improved image formation apparatus and sublimation printer that overcome the problems of the conventional art. This invention addresses this need in the art as well as other needs, which will become apparent to those skilled in the art from this disclosure.

SUMMARY OF THE INVENTION

It is an object of the present invention to provide a sublimation printer that generates the required pressing force in a stable manner.

The image formation apparatus in accordance with the first aspect of the present invention includes a main frame having first and second side panels; a platen roller rotatably held between the first and second side panels of the main frame; a head assembly having an arm portion and a head portion; and a press lever pivotably supported on the first side panel of the main frame. The head assembly is pivotably held between the first and second side panels of the main frame so as to be pressed against and moved away from the platen roller. The press lever presses the head portion against the platen roller in a first direction when the press lever is pivoted. The first side panel has a groove that supports the press lever. The groove at least partially has a first wall portion on which the press lever abuts from a second direction that is opposite the first direction.

With this constitution, there is little displacement of the press lever of deformation of the main frame after repeated use of the image formation apparatus because the reaction force that acts on the press lever when the head assembly presses against the platen roller is borne by the side walls. Here, a structure in which the reaction force acting in the direction parallel to the side panel is borne by a wall portion of a groove formed at a distance from the edge of the side panel is stronger than a structure in which the reaction force acting is borne by a protrusion formed by bending a planar portion of the lid. Therefore, deformation of the side panel is unlikely to be caused by this reaction force. Specifically, the reaction force does not deform the main frame.

The image formation apparatus in accordance with the second aspect of the present invention is the image formation apparatus of the first aspect of the present invention, in which the groove portion has a first groove portion and a second groove portion. The first groove portion has an opening on an edge portion of the first side panel. The second groove portion communicates with the first groove portion and has the first wall portion on which the press lever abuts from the second direction.

With this constitution, the press lever can be installed in the main frame by first inserting a rotary shaft of the press lever into the first groove portion, and then disposing the press lever at the end of the second groove portion via this first groove portion. In other words, the structure in which the above-mentioned reaction force is borne by the side panel can be created by simply installing the press lever in the main frame.

The image formation apparatus in accordance with the third aspect of the present invention is the image formation apparatus of the second aspect of the present invention, in which the groove portion is shaped such that the first groove portion and the second groove portion are substantially perpendicular to one another.

With this constitution, the structure of the groove is simplified in an L-shape. In the groove, the rotary shaft of the press lever is inserted in the first groove portion, while the second groove portion that bears the reaction force is formed substantially perpendicular to the first groove portion.

The image formation apparatus in accordance with the fourth aspect of the present invention is the image formation apparatus of the first aspect of the present invention, further including a lid portion formed to be disposed on top of the main frame. The lid portion has a protrusion that is formed to be fitted into the groove of the first side panel. The protrusion has a second wall portion on which the press lever abuts from a direction intersecting with the second direction.

With this constitution, the rotary shaft of the press lever is supported by the first wall portion of the groove, as well as by the second wall portion of the protrusion of the lid. Thus, so the rotary shaft of the press lever is supported from all four sides. Accordingly, the force that is generated during pivoting of the press lever and displaces the rotary shaft of the press lever in the direction in which the groove extends is borne by the second wall portion of the protrusion of the lid, which prevents the rotary shaft from moving along the groove.

The image formation apparatus in accordance with the fifth aspect of the present invention is the image formation apparatus of the fourth aspect of the present invention, in which the press lever presses the head portion against the platen roller in a downward direction. The press lever abuts on the second wall portion of the protrusion from a horizontal direction.

The image formation apparatus in accordance with the sixth aspect of the present invention is the image formation apparatus of the first aspect of the present invention, further including a motor, and a gear assembly that pivots the press lever as the motor operates.

The image formation apparatus in accordance with the seventh aspect of the present invention is the image formation apparatus of the first aspect of the present invention, in which the head portion is a thermal header.

The image formation apparatus in accordance with the eighth aspect of the present invention is the image formation apparatus of the first aspect of the present invention, in which the image formation apparatus is a sublimation printer.

A sublimation printer in accordance with the ninth aspect of the present invention includes a main frame having side panels; a thermal head; a platen roller rotatably held between the side panels of the main frame; pressing means for pressing the thermal head against the platen roller with a predetermined pressing force, the pressing means being supported by the main frame; and supporting means for supporting the pressing means against reaction force of the pressing force.

The sublimation printer in accordance with the tenth aspect of the present invention is the sublimation printer in accordance with the ninth aspect of the present invention, in which the supporting means supports the pressing means in a direction opposite a direction of the pressing force.

The sublimation printer in accordance with the eleventh aspect of the present invention is the sublimation printer in accordance with the ninth aspect of the present invention, in which the supporting means supports the pressing means in a direction intersecting a direction of the reaction force.

The sublimation printer in accordance with the twelfth aspect of the present invention is the sublimation printer in accordance with the ninth aspect of the present invention, in which the pressing means presses the thermal head against the platen roller in a downward direction, and the support means supports the pressing means in a horizontal direction.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

The sublimation printer 100 according to an embodiment of the present invention will now be described.

Figure 1:
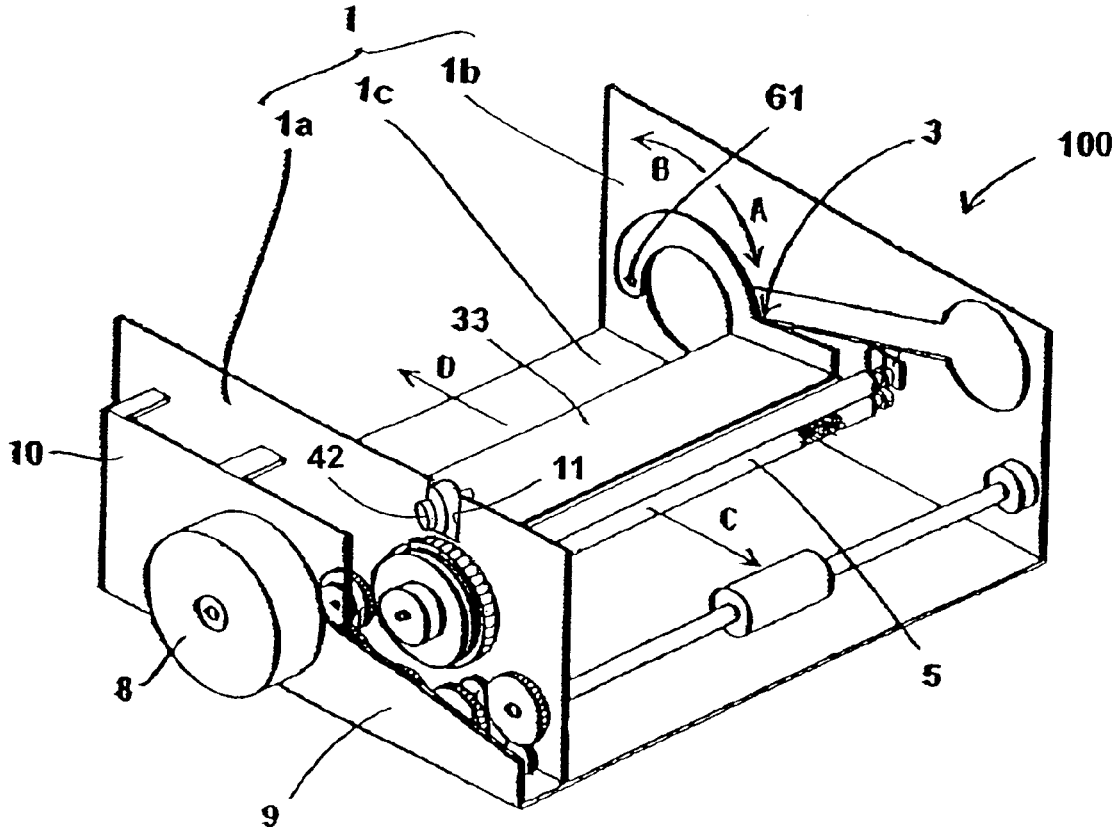
FIG. 1 is a perspective view of the printing component of a sublimation printer in accordance with an embodiment of the present invention.
Figure 2:
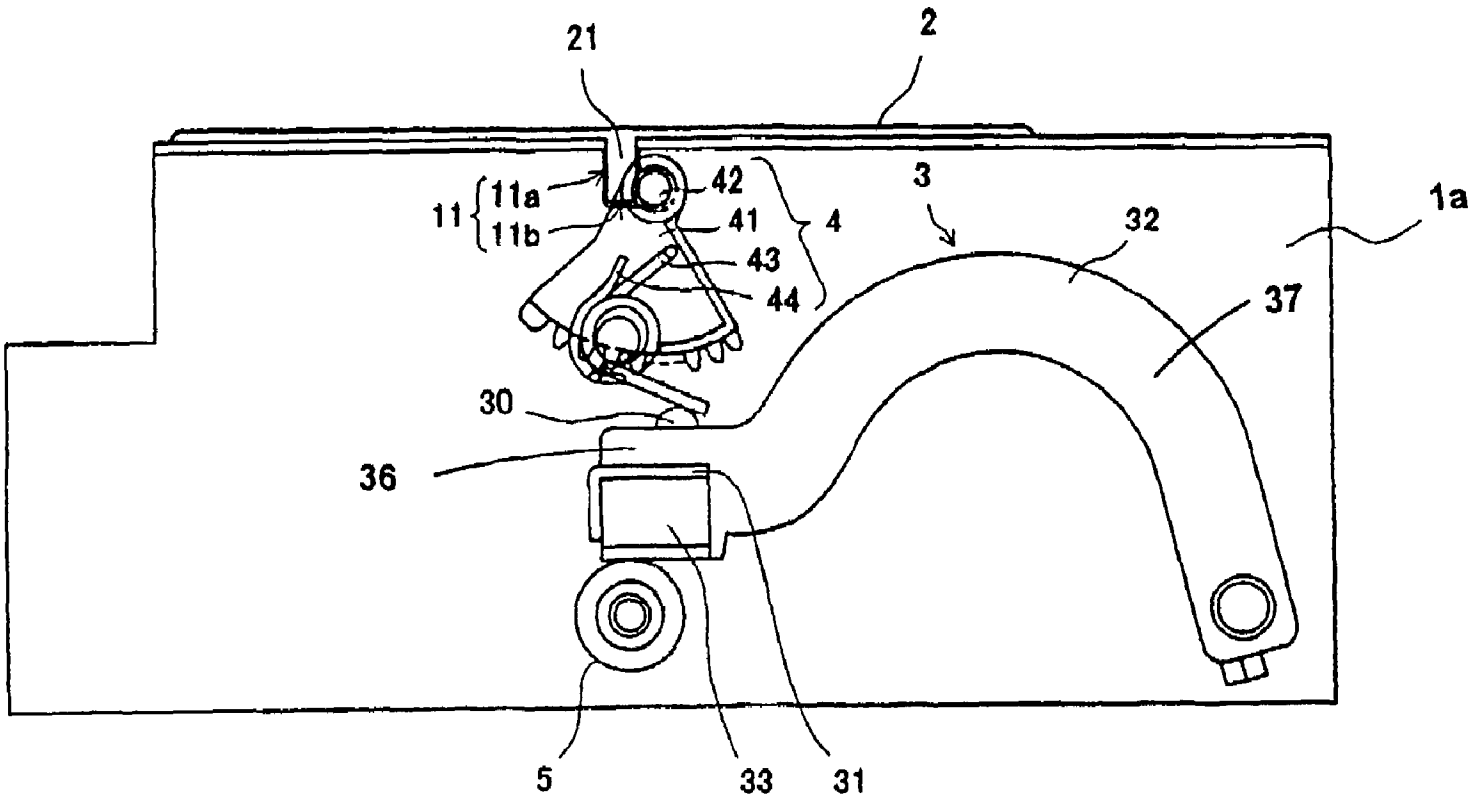
FIG. 2 is a diagram illustrating the structure in the vicinity of the printing component of a sublimation printer in accordance with the embodiment of the present invention.

FIG. 1 is a perspective view of a dye sublimation printer 100 in accordance with an embodiment of the present invention. FIG. 2 is a simplified diagram illustrating the structure in the vicinity of the printing component of a sublimation printer 100 in accordance with the embodiment of the present invention.

Figure 3:
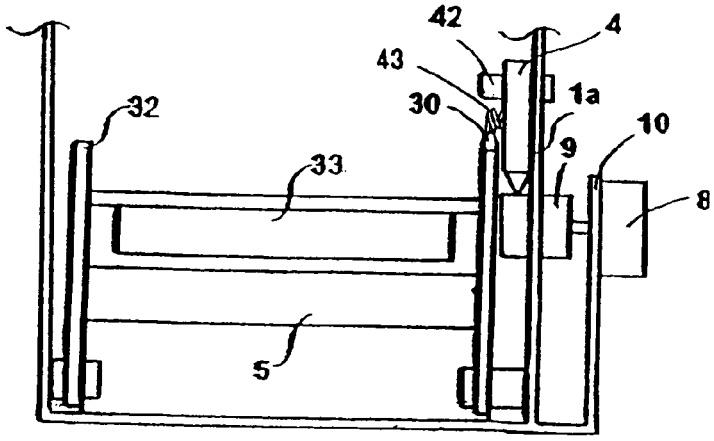
FIG. 3 is a diagram illustrating the attachment structure of the head assembly in the sublimation printer in accordance with the embodiment of the present invention.

As shown in FIGS. 1-3, the sublimation printer in this embodiment includes a main frame 1 having side panels 1*a* and 1*b* and a gear case 10 that are connected with a bottom panel 1*c*; a platen roller 5 rotatably held between the side panels 1*a* and 1*b* of the main frame 1; a head assembly 3 pivotably held between the side plates 1*a* and 1*b* and including a thermal head 33 located across from the platen roller 5; a press lever 4 that pivots the head assembly 3 and presses the thermal head 33 against the platen roller 5; a lid 2 disposed on the top side of the side panels 1*a* and 1*b*; a motor 8; and a gear assembly 9 (omitted in FIG. 2).

The platen roller 5 is installed with its axial direction perpendicular to the paper conveyance direction. In FIG. 2, the left-right direction is the paper conveyance direction, and the direction of the rotational axis of the platen roller 5 is perpendicular to the paper plane of FIG. 2.

The head assembly 3 includes the thermal head 33, a head support 31 for supporting the thermal head 33 from the top and side, and a head pressing arm 32 for supporting the head support 31. The thermal head 33 is substantially cuboid in shape, and its lengthwise direction is perpendicular to the paper conveyance direction. In other words, the thermal head 33 extends in a direction perpendicular to the paper plane of FIG. 2.

The head support 31 includes portions that come into contact with the top and side of the thermal head 33. This head support 31 is connected to the head pressing arm 32. The head pressing arm 32 includes a connecting component that connects to the head support 31, and a pair of arm components 37 that extend perpendicular to the axial direction of the thermal head 33. In other words, the arm components 37 of the head pressing arm 32 extend in the paper conveyance direction. The connecting component 36 and the arm components 37 of the head pressing arm 32 are formed integrally as a unitary member. A boss 30 that is semicircular in cross section and protrudes upward is provided to the top of the head pressing arm 32 at a point close to the conveyance direction end of the head support 31. The end of the head pressing arm 32 that is not connected to the head support 31 is pivotably supported by the side panel 1*a* of the main frame 1.

Figure 4:
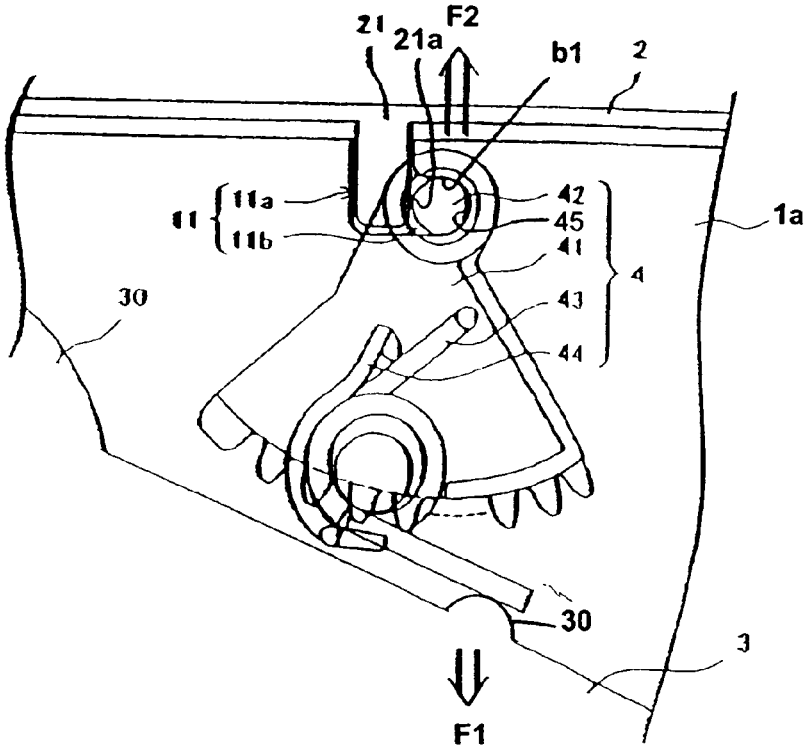
FIG. 4 is a diagram illustrating the structure of the press lever 4 in accordance with the embodiment of the present invention.
Figure 5:
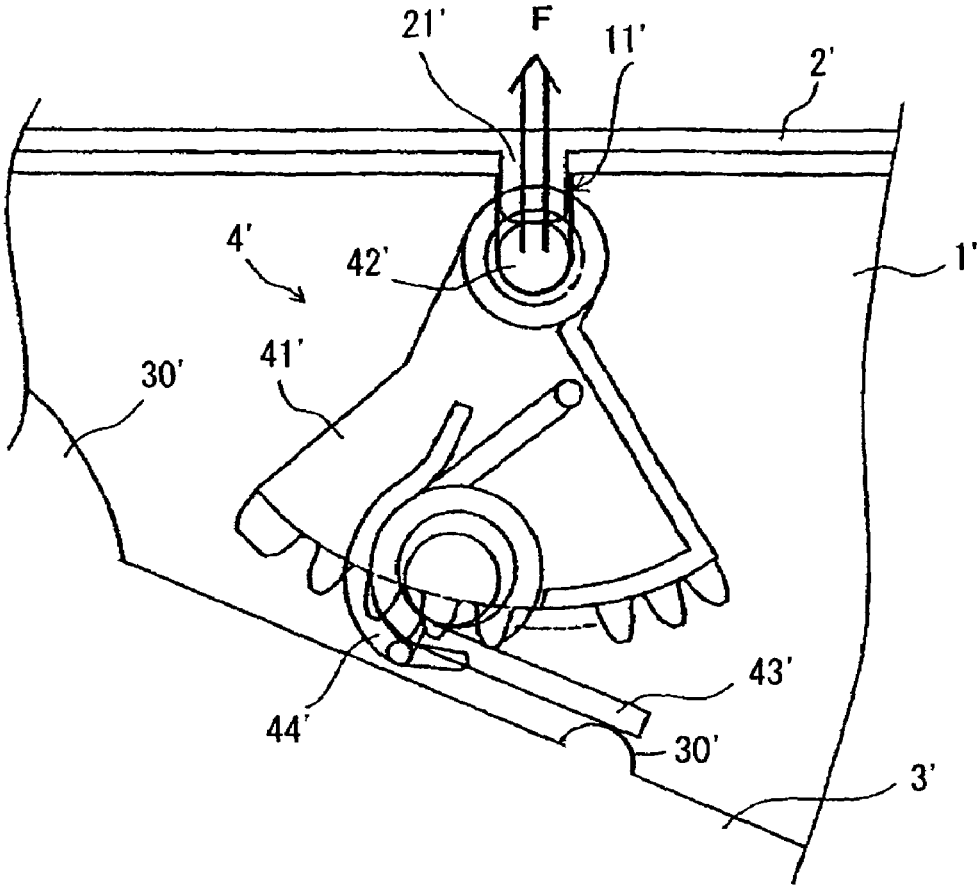
FIG. 5 is a diagram illustrating the structure of a conventional press lever 4'.

FIG. 4 is a diagram of the structure of the press lever 4. The press lever 4 includes a fan plate 41, a rotary shaft 42, and a torsion spring 43. The fan plate 41 is substantially fan-shaped and has at its apex a through-hole 45 in which a rotary shaft 42 is fitted. The rotary shaft 42 is also rotatably fitted into a groove 11 formed in the side panel 1*a*. The torsion spring 43 is coupled near an arc-shaped surface of the fan plate 41 via a fixing member 44 with one end of the torsion spring 43 protruding beyond the arc-shaped surface of the fan plate 41. A plurality of teeth is formed on the arc-shaped surface of the fan plate 41, such that the plurality of teeth engages a motor via an external gear (not shown).

In the side panel 1*a* of the main frame 1, an L-shaped groove 11 having a first groove portion 11*a* and a second groove portion 11*b* is formed. The first groove portion 11*a* has an opening at the top of the side panel 1*a*. The second groove portion 11*b* communicates with the first groove portion 11*a* and extends in a direction perpendicular to the direction in which the first groove portion 11*a* extends. The rotary shaft 42 of the press lever 4 is fitted into the end of this second groove portion 11*b*.

On the lid 2 is formed a protrusion 21 that bends toward the side panel 1*a* and is located at a position that corresponds to the portion of the side panel 1*a* where the first groove portion 11*a* of the groove 11 is formed. This protrusion 21 is formed in a shape that matches with the contour of the first groove portion 11*a* of the groove 11 when the lid 2 is placed on top of the side panel 1*a*, such that the protrusion 21 fits into the first groove portion 11*a*.

With this constitution, when the motor 8 is rotated, the gear assembly 9 connected to the rotary shaft of the motor 8 rotates, and the rotation of this gear assembly 9 causes the press lever 4 to pivot around the rotary shaft 42. The torsion spring 43 pivots together with the press lever 4, such that one end of the torsion spring 43 strikes the boss 30 formed on the head pressing arm 32. When this press lever 4 is pivoted further, one end of the torsion spring 43 is pivoted further downward and pushes the boss 30. Accordingly, the head pressing arm 32, in other words the head assembly 3, is pivoted diagonally downward, so that the thermal head 33 is pressed at the specified pressing force F1 against the platen roller 5 with the paper and the ink ribbon therebetween.

Here, the reaction force F2 resulting from this pressing force F1 acts on the press lever 4 in a direction opposite the direction of the pressing force F1 along a depth direction of the groove 11. As shown in FIG. 4, this reaction force F2 pushes the rotary shaft 42 of the press lever 4 upward (upward along a depth direction of the groove 11). However, since the top of the rotary shaft 42 hits the top wall of the second groove portion 11*b* of the groove 11 formed in the side panel 1*a*, this reaction force F2 does not cause the rotary shaft 42 to move.

Next, the printing operation with the sublimation printer 100 of this embodiment will be described. The sublimation printer 100 in accordance with this embodiment is a printer that prints color images. An ink ribbon is flanked on both sides by the thermal head 33, and is played out from the paper feed side and wound in on the paper discharge side. The ink ribbon has cyan, magenta, and yellow ink ribbons connected to one another in that order. The length of the ink ribbon of each color is the same as the conveyance direction length of the paper on which the color images are to be printed.

When the color images to be printed are inputted, the sublimation printer 100 subjects the inputted color images to color separation, producing cyan images, magenta images, and yellow images. The sublimation printer 100 feeds in paper from a paper feeder (not shown), and the front end of the cyan ink ribbon is aligned with the front end of the paper in front of the thermal head 33 and fed in this state between the platen roller 5 and the thermal head 33. Once the front end of the paper reaches the printing position of the thermal head 33, the press lever 4 is pivoted so that the torsion spring 43 presses down on the boss 30 of the head assembly 3. This causes the thermal head 33 to press against the platen roller 5 with sufficient pressing force. The ink ribbon and paper are conveyed with one pressed against the other between the platen roller 5 and the thermal head 33. At this time, the paper is conveyed by a conveyor roller (not shown), while the ink ribbon is wound in on the paper discharge side. Once the rear end of the paper reaches the printing position of the thermal head 33, the feeding of the paper and the winding of the ink ribbon are halted. Then, the press lever 4 is pivoted so that the torsion spring 43 is no longer touching the boss 30 formed on the head assembly 3. This completes the printing of a cyan image, at which point the printing of a magenta image over this cyan image is commenced.

In this state, only the paper is conveyed back to the paper feed side. The front end of the paper and the front end of the magenta ink ribbon are aligned together and fed in this state between the platen roller 5 and the thermal head 33. Once the front end of the paper reaches the printing position of the thermal head 33, the press lever 4 is pivoted so that the torsion spring 43 presses down on the boss 30 of the head assembly 3. This causes the thermal head 33 to press against the platen roller 5 with sufficient pressing force. The ink ribbon and paper are conveyed with one pressed against the other between the platen roller 5 and the thermal head 33. At this time, the paper is conveyed by a conveyor roller (not shown), while the ink ribbon is wound in on the paper discharge side. Once the rear end of the paper reaches the printing position of the thermal head 33, the feeding of the paper and the winding of the ink ribbon are halted, and the press lever 4 is pivoted so that the torsion spring 43 is no longer touching the boss 30 formed on the head assembly 3. This completes the printing of a magenta image, at which point the printing of a yellow image over this magenta image is commenced.

As in the above step of printing magenta images, only the paper is conveyed back to the paper feed side. The front end of the paper and the front end of the yellow ink ribbon are aligned together and fed in this state between the platen roller 5 and the thermal head 33. Once the front end of the paper reaches the printing position of the thermal head 33, the press lever 4 is pivoted so that the torsion spring 43 presses down on the boss 30 of the head assembly 3. This causes the thermal head 33 to press against the platen roller 5 with sufficient pressing force. The ink ribbon and paper are conveyed with one pressed against the other between the platen roller 5 and the thermal head 33. At this time, the paper is conveyed by a conveyor roller (not shown), while the ink ribbon is wound in on the paper discharge side. Once the rear end of the paper reaches the printing position of the thermal head 33, the feeding of the paper and the winding of the ink ribbon are halted, and the press lever 4 is pivoted so that the torsion spring 43 is no longer touching the boss 30 formed on the head assembly 3. This completes the printing of a yellow image, and also completes the printing of a color image.

With a sublimation printer 100 constituted as above, the rotary shaft 42 of the press lever 4 is supported by the horizontal wall portion 11*b*1, (an example of the first wall portion) of the second groove portion 11*b* of the groove 11 in the side panel 1*a*, which prevents the rotary shaft 42 from being displaced by the reaction force F2 that is generated when the head assembly 3 presses against the platen roller 5 with the pressing force F1. Furthermore, since the groove 11 is formed at a position away from the upper edge of the side panel 1*a* with the second groove portion 11*b* that is not open upward, the groove 11 is strong against an upward force, and does not deform even after being repeatedly subjected to the above-mentioned reaction force F2. Therefore, the position of the rotary shaft 42 is not changed by the repeated reaction force F2 generated during the printing operations. As a result, the sublimation printer 100 can securely press the thermal head 33 of the head assembly 3 against the platen roller 5 at the predetermined pressing force F1.

Also, the groove 11 is formed in an L-shape, with a first groove portion 11*a* having an opening at the upper edge of the side panel 1*a*, and a second groove portion 11*b* having upper and lower sides that is perpendicular to the first groove portion 11*a*. Therefore, the press lever 4 can be fitted into the second groove portion 11*b* through the first groove portion 11*a* when installed on the side panel 1*a* of the main frame 1. In other words, the press lever 4 can be installed very easily.

Also, the protrusion 21 of the lid 2 is fitted into the first groove portion 11*a* of the groove 11 such that the rotary shaft 42 horizontally abuts on the side wall 21*a* of the protrusion 21 (an example of the second wall portion). Thus, the rotary shaft 42 is supported from all four sides, and its position on the side panel 1*a* can be secured. As a result, even though the direction in which the reaction force F2 is exerted changes as the press lever 4 pivots and a reaction force may be exerted in the direction along the second groove portion 11*b*, such reaction force is borne by the side wall 21*a* of the protrusion 21. Thus, the movement of the rotary shaft 42 in the direction of the second groove portion 11*b* (the horizontal direction) can be prevented effectively, thereby preventing the rotary shaft 42 from being displaced in the horizontal direction.

Furthermore, although the groove 11 is formed in an L-shape in the above embodiment, its shape is not limited to such shape and can be varied as desired, as long as the groove includes a wall portion on which the rotary shaft abuts from the direction of the reaction force.

With the present invention, the reaction force that is generated when the head assembly presses against the platen roller and that acts on the rotary shaft of the press lever is borne by the main frame. Thus, a sublimation printer that does not become deformed after repeated use can be formed with a simple structure. As a result, the pressing force with which the head assembly presses against the platen roller is less likely to change after repeated use. Therefore, the sublimation printer can perform the printing operation more reliably.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2004-132722. The entire disclosure of Japanese Patent Application No. 2004-132722 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image formation apparatus, comprising:

a main frame having first and second side panels, the first side panel having a groove;

a platen roller rotatably held between the first and second side panels of the main frame;

a head assembly having an arm portion and a head portion, the head assembly being pivotably held between the first and second side panels of the main frame so as to be pressed against and moved away from the platen roller; and a press lever pivotably supported on the first side panel of the main frame, the press lever pressing the head portion against the platen roller in a first direction when the press lever is pivoted, the press lever having a plurality of teeth configured to engage a motor via an external gear;

the groove supporting the press lever, the groove at least partially having a first wall portion on which the press lever abuts in a second direction that is opposite the first direction along a depth direction of the groove.

2. The image formation apparatus according to claim 1, wherein the groove has a first groove portion and a second groove portion, the first groove portion having an opening on an edge portion of the first side panel, the second groove portion communicating with the first groove portion and having the first wall portion on which the press lever abuts in the second direction.

3. The image formation apparatus according to claim 1, further comprising a lid portion formed to be disposed on top of the main frame, the lid portion having a protrusion that is formed to be fitted into the groove of the first side panel, the protrusion having a second wall portion on which the press lever abuts from a direction intersecting with the second direction.

4. The image formation apparatus according to claim 1, further comprising a motor; and a gear assembly that pivots the press lever as the motor operates.

5. The image formation apparatus according to claim 1, wherein the head portion is a thermal header.

6. The image formation apparatus according to claim 1, wherein the image formation apparatus is a sublimation printer.

7. An image formation apparatus comprising:

a main frame having first and second side panels, the first side panel having a groove;

a platen roller rotatably held between the first and second side panels of the main frame;

a head assembly having an arm portion and a head portion, the head assembly being pivotably held between the first and second side panels of the main frame so as to be pressed against and moved away from the platen roller;

a press lever pivotably supported on the first side panel of the main frame, the press lever pressing the head portion against the platen roller in a first direction when the press lever is pivoted; and a lid portion formed to be disposed on top of the main frame, the groove supporting the press lever, the groove at least partially having a first wall portion on which the press lever abuts in a second direction that is opposite the first direction along a depth direction of the groove, the lid portion having a protrusion that is formed to be fitted into the groove of the first side panel, the protrusion having a second wall portion on which the press lever abuts from a direction intersecting with the second direction, the press lever pressing the head portion against the platen roller in a downward direction, and the press lever abutting on the second wall portion of the protrusion from a horizontal direction.

8. An image formation apparatus comprising:

a main frame having first and second side panels;

a platen roller rotatably held between the first and second side panels of the main frame;

a head assembly having an arm portion and a head portion, the head assembly being pivotably held between the first and second side panels of the main frame so as to be pressed against and moved away from the platen roller; and a press lever pivotably supported on the first side panel of the main frame, the press lever pressing the head portion against the platen roller in a first direction when the press lever is pivoted, the press lever having a plurality of teeth configured to engage a motor via an external gear;

the first side panel having a groove that supports the press lever, the groove having a first groove portion and a second groove portion, the first groove portion having an opening on an edge portion of the first side panel, the second groove portion communicating with the first groove portion and having the first wall portion on which the press lever abuts in the second direction that is opposite the first direction, the groove being shaped such that the first groove portion and the second groove portion are substantially perpendicular to one another.

9. A sublimation printer, comprising:

a main frame having side panels, one of the side panels having a groove;

a thermal head;

a platen roller rotatably held between the side panels of the main frame;

pressing means for pressing the thermal head against the platen roller with a predetermined pressing force, the pressing means being supported by the main frame, the pressing means having a plurality of teeth configured to engage a motor via an external gear; and supporting means for supporting the pressing means against reaction force of the pressing force, the reaction force acting upward along a depth direction of the groove.

10. The sublimation printer according to claim 9, wherein the supporting means supports the pressing means from a direction opposite a direction of the pressing force.

11. The sublimation printer according to claim 9, wherein the supporting means supports the pressing means in a direction intersecting a direction of the reaction force.

12. The sublimation printer according to claim 11, wherein the pressing means presses the thermal head against the platen roller in a downward direction, and the support means supports the pressing means in a horizontal direction.

* * * * *